US011541660B2

(12) United States Patent
Hirasawa

(10) Patent No.: US 11,541,660 B2
(45) Date of Patent: Jan. 3, 2023

(54) WASTE LIQUID CONTAINER AND LIQUID EJECTING APPARATUS

(71) Applicant: SEIKO EPSON CORPORATION, Tokyo (JP)

(72) Inventor: Yusuke Hirasawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/366,254

(22) Filed: Jul. 2, 2021

(65) Prior Publication Data

US 2022/0001670 A1 Jan. 6, 2022

(30) Foreign Application Priority Data

Jul. 6, 2020 (JP) ..... JP2020-116208

(51) Int. Cl.
*B41J 2/17* (2006.01)

(52) U.S. Cl.
CPC ..... *B41J 2/1721* (2013.01); *B41J 2002/1728* (2013.01)

(58) Field of Classification Search
CPC ..... B41J 2/1721; B41J 2002/1728; B41J 2002/1742; B41J 29/13; B41J 2/16523; B41J 35/38; B41J 2002/1735; B41J 2002/1856
See application file for complete search history.

(56) References Cited

U.S. PATENT DOCUMENTS 10,338,517 B2 7/2019 Hirasawa
10,518,542 B2 12/2019 Ochiai et al.

FOREIGN PATENT DOCUMENTS

JP H09-076529 A 3/1997
JP 2018-111279 A 7/2018
JP 2019-018405 A 2/2019

*Primary Examiner* — Kristal Feggins
(74) *Attorney, Agent, or Firm* — Oliff PLC

(57) ABSTRACT

A waste liquid container is detachably attached to an attachment section that is, in a use state, positioned on a down-direction side of a discharge section that discharges waste liquid from a liquid ejecting head, and the waste liquid container includes: a storage section having an inlet section that is positioned on an up-direction side and introduces the waste liquid which flows down from the discharge section; an absorbing member that is accommodated in the storage section, forms the inlet section, and absorbs the waste liquid introduced to the inlet section; and an accumulation region that communicates with the inlet section inside the storage section, is positioned on the down-direction side of the inlet section, is formed to have an area, when viewed in plan view from a top, larger than an area of the inlet section, and is configured to accumulate the waste liquid in a bubble form.

5 Claims, 8 Drawing Sheets

WASTE LIQUID CONTAINER AND LIQUID EJECTING APPARATUS

The present application is based on, and claims priority from JP Application Serial Number 2020-116208, filed Jul. 6, 2020, the disclosure of which is hereby incorporated by reference herein in its entirety.

BACKGROUND

1. Technical Field

The present disclosure relates to a waste liquid container and a liquid ejecting apparatus.

2. Related Art

There have been liquid ejecting apparatuses including a waste liquid container that stores, as waste ink (waste liquid), ink (liquid) that is discharged when maintenance of a liquid ejecting head is performed. Examples of liquid used for liquid ejecting apparatuses include sublimation-transfer ink.

Note that JP-A-9-76529 discloses an ink absorbing apparatus (waste liquid container) having a structure in which a plurality of ribs are provided upright on the bottom surface of a rectangular parallelepiped container that is open at the top and in which a rectangular parallelepiped absorber is provided on the ribs such that an outer periphery of the absorber is fitted to an inner wall of the container.

Sublimation-transfer ink is likely to be in a bubble form when the ink flows. Furthermore, during maintenance, the sublimation-transfer ink is likely to be in a bubble form when the ink is stored in the waste liquid container as waste ink (waste liquid). Note that, since waste liquid in a bubble form is not absorbed by an absorbing member in a short time compared with waste liquid in a liquid form, when the waste liquid in the bubble form is insufficiently absorbed by the absorbing member, there is a problem that the waste liquid in the bubble form readily leaks from the waste liquid container.

SUMMARY

A waste liquid container is detachably attached to an attachment section that is, in a use state, positioned on a down-direction side of a discharge section that discharges waste liquid from a liquid ejecting head, and the waste liquid container includes: a storage section having an inlet section that is positioned on an up-direction side and introduces the waste liquid which flows down from the discharge section; an absorbing member that is accommodated in the storage section, forms the inlet section, and absorbs the waste liquid introduced to the inlet section; and an accumulation region that communicates with the inlet section inside the storage section, is positioned on the down-direction side of the inlet section, is formed to have an area, when viewed in plan view from a top, larger than an area of the inlet section, and is configured to accumulate the waste liquid in a bubble form.

A liquid ejecting apparatus includes: the waste liquid container described above; a liquid ejecting head that ejects a liquid; a discharge section that discharges waste liquid from the liquid ejecting head; and an attachment section which is positioned on the down-direction side of the discharge section and to which the waste liquid container is detachably attached.

DESCRIPTION OF EXEMPLARY EMBODIMENTS

1. First Embodiment

Figure 1:
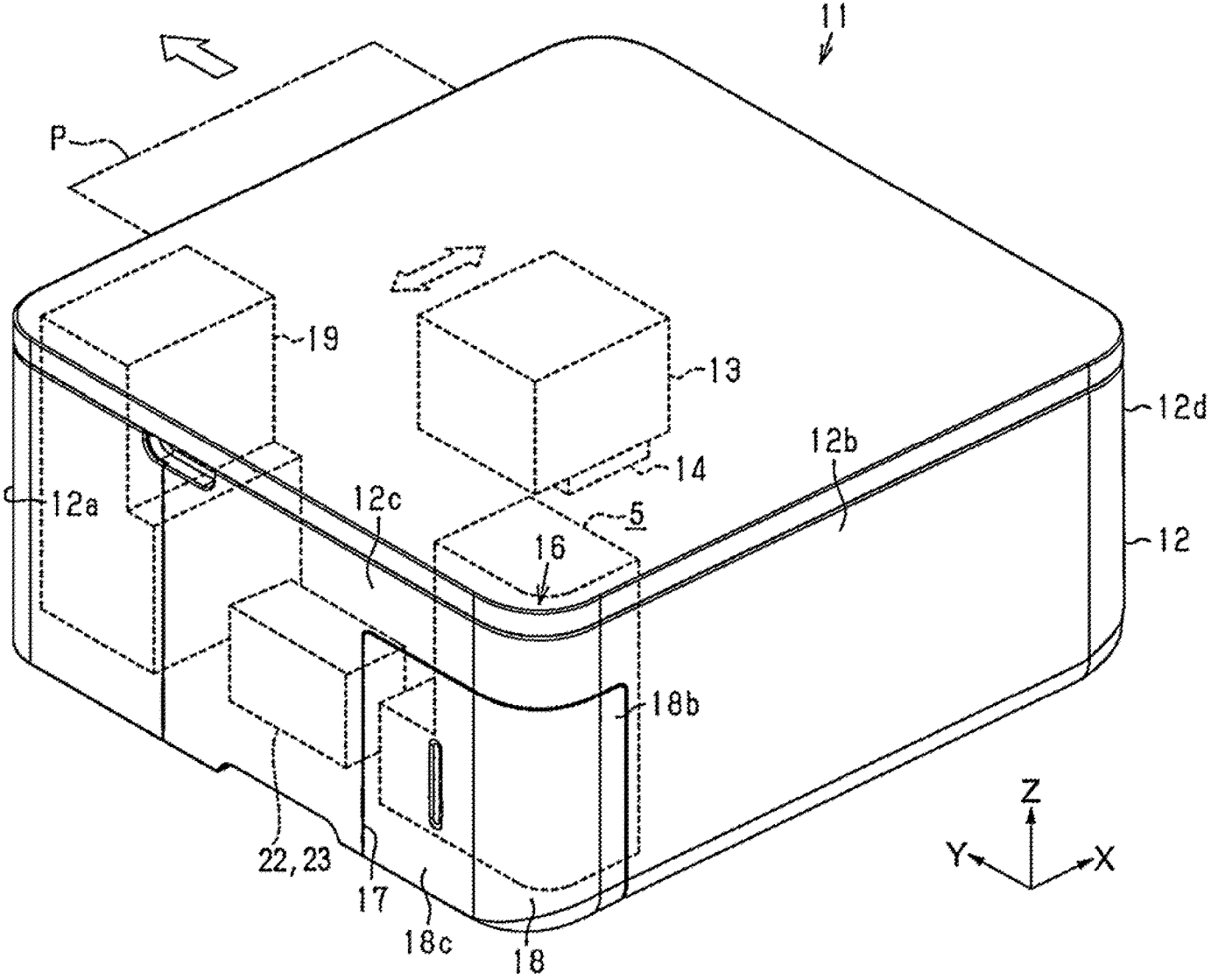
FIG. 1 is a perspective view illustrating an appearance of a liquid ejecting apparatus according to a first embodiment.

A liquid ejecting apparatus including an attachment section to which a waste liquid container according to the present embodiment is detachably attached will be described. Note that the liquid ejecting apparatus of the present embodiment is constituted by an ink jet printer that performs printing by ejecting ink which is an example of a liquid onto paper which is an example of a medium. The printer adopts, as a printing method, a so-called serial method in which printing is performed while a liquid ejecting head is reciprocated in a main-scanning direction intersecting a paper transport direction.

An X–Y–Z coordinate system is used in the drawings. The X direction is defined as a movement direction of a carriage (main-scanning direction) that moves with a liquid ejecting head mounted thereon, and the X direction corresponds to a width direction of the liquid ejecting apparatus. The Y direction is a depth direction of the liquid ejecting apparatus and corresponds to the paper transport direction and a paper discharge direction. The Z direction is a vertical direction orthogonal to the X direction and the Y direction and corresponds to a height direction of the liquid ejecting apparatus.

Regarding the Z direction, a vertically up direction corresponding to an up direction of the apparatus is defined as a +Z direction, and a vertically down direction corresponding to a down direction of the apparatus is defined as a −Z direction. Moreover, the +Z direction is called the up direction, and the −Z direction is called the down direction. Regarding the Y direction, a direction in which paper is discharged from the inside of the apparatus as indicated by an arrow outlined by a solid line in FIG. 1 is defined as a +Y direction, and a direction opposite thereto is defined as a −Y direction. Moreover, the +Y direction is called a front direction, and the −Y direction is called a rear direction. Regarding the X direction, in a right-left direction when the apparatus is viewed from the +Y direction side, a direction toward the right side of the apparatus is defined as a −X direction, and a direction toward the left side of the apparatus is defined as a +X direction. Moreover, the +X direction is called a left direction, and the −X direction is called a right direction.

As illustrated in FIG. 1, a liquid ejecting apparatus 11 includes a housing 12 of a rectangular parallelepiped shape whose longitudinal direction is the X direction, which corresponds to the width direction. Inside the housing 12, a carriage 13 of a box shape is provided, so as to be able to be reciprocated in the X direction, which is the main-scanning direction, on the up-direction side of a transport region in which paper P is transported during printing as indicated by arrows outlined by dashed lines in FIG. 1. A liquid ejecting head 14 capable of ejecting ink (liquid) onto the paper P transported in the transport region is mounted below the carriage 13.

In the present embodiment, sublimation-transfer ink is used as the ink. The sublimation-transfer ink is ink that contains a large amount of materials for suppressing sedimentation or a large amount of surfactants and that is likely to be in a bubble form when the ink flows.

The housing 12 has, when viewed in plan view from the top, a surface (front surface 12*a*) in the front direction, on which a discharge port (not illustrated) for discharging the paper P is formed, a surface (rear surface 12*b*) opposite to the front surface 12*a*, and surfaces (a right surface 12*c* and a left surface 12*d*) that constitute side surfaces adjoining the front surface 12*a* and the rear surface 12*b*. An opening 17 having a rectangular cut-out shape is formed in an adjoining section 16 in which the right surface 12*c* and the rear surface 12*b* adjoin each other. The opening 17 is provided so as to extend across the right surface 12*c* and the rear surface 12*b*.

A cover 18 is detachably attached to the opening 17. When attached to the opening 17, the cover 18 covers the opening 17. The cover 18 has a rear surface 18*b* and a right surface 18*c* that respectively extend along the rear surface 12*b* and the right surface 12*c* of the housing 12 in a state where the cover 18 is attached to the opening 17.

As illustrated in FIG. 1, a liquid storage section 19 that has a tank shape and stores ink to be supplied to the liquid ejecting head 14 is arranged inside the housing 12 at a position on the right-direction side so as to be further than a reciprocation region of the carriage 13 in the front direction. A flexible liquid supply tube (not illustrated) is drawn out from the liquid storage section 19, and a tip end corresponding to a downstream end of the liquid supply tube is coupled to a tube coupling section (not illustrated) provided above the carriage 13.

A maintenance unit 22 capable of carrying out maintenance of the liquid ejecting head 14 is arranged inside the housing 12 at a position directly below the liquid ejecting head 14 when the carriage 13 on which the liquid ejecting head 14 is mounted moves to a position distanced from the transport region of the paper P to the right-direction side in the width direction.

As illustrated in FIG. 1, the maintenance unit 22 includes a cap 23 for receiving waste liquid which is not used for printing and is discharged from the liquid ejecting head 14 as waste ink, a waste liquid tube 24 (refer to FIG. 5) that is flexible and is drawn out from the cap 23 so as to be able to guide the waste liquid from the inside of the cap 23, and a tube pump (not illustrated) that is provided halfway in the waste liquid tube 24 in the longitudinal direction of the waste liquid tube 24. The waste liquid is sucked from the inside of the cap 23 into the waste liquid tube 24 in accordance with driving of the tube pump.

A waste liquid container 5 capable of storing the waste liquid is arranged inside the housing 12 at a position which is on the rear direction side of the liquid storage section 19 and which is adjacent to the rear-direction side of the maintenance unit 22 in the front-rear direction of the housing 12. The waste liquid sucked from the inside of the cap 23 into the waste liquid tube 24 is collected (stored) in the waste liquid container 5 in accordance with driving of the tube pump.

Figure 2:
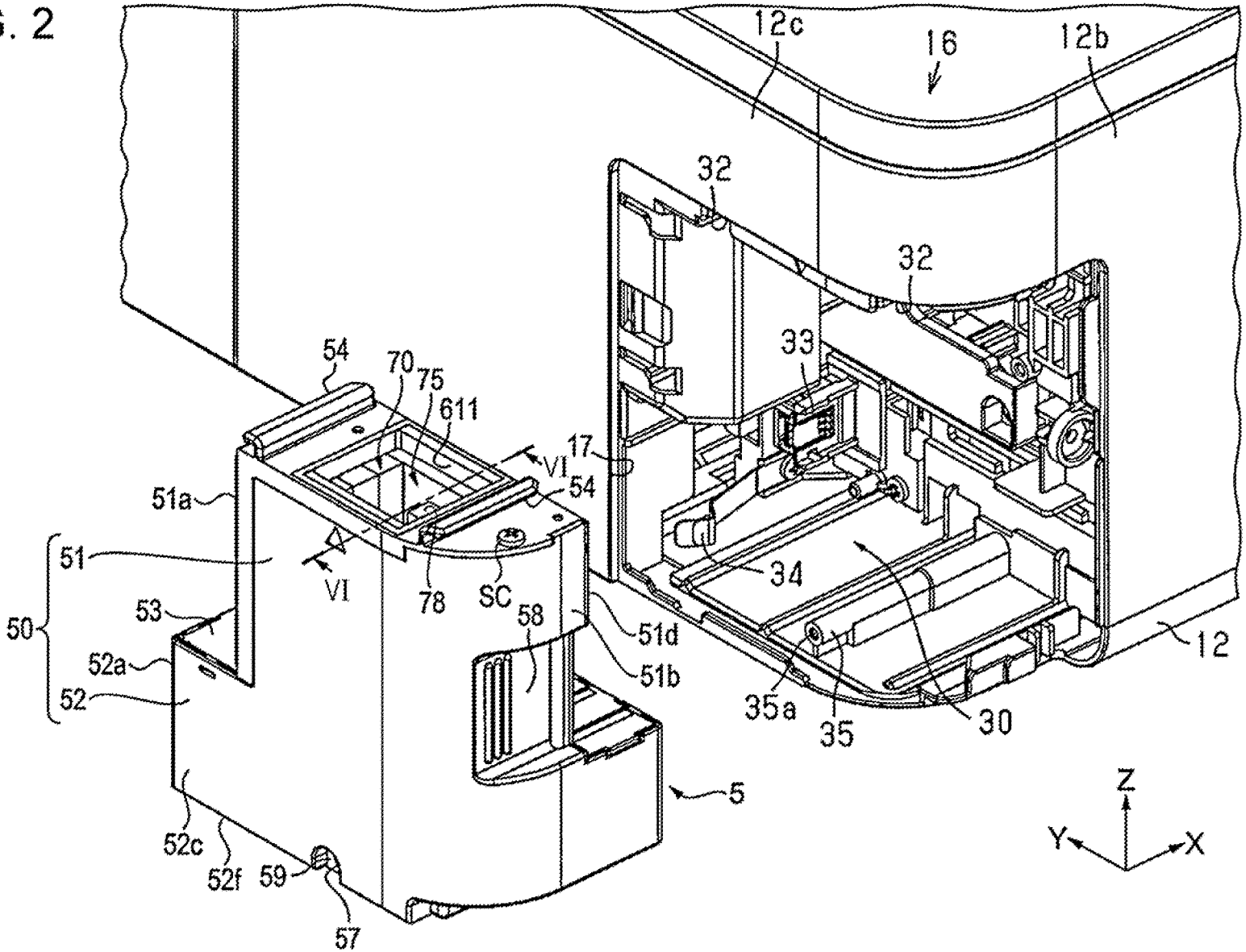
FIG. 2 is a partial perspective view illustrating a state in which a waste liquid container is detached from an attachment section.
Figure 3:
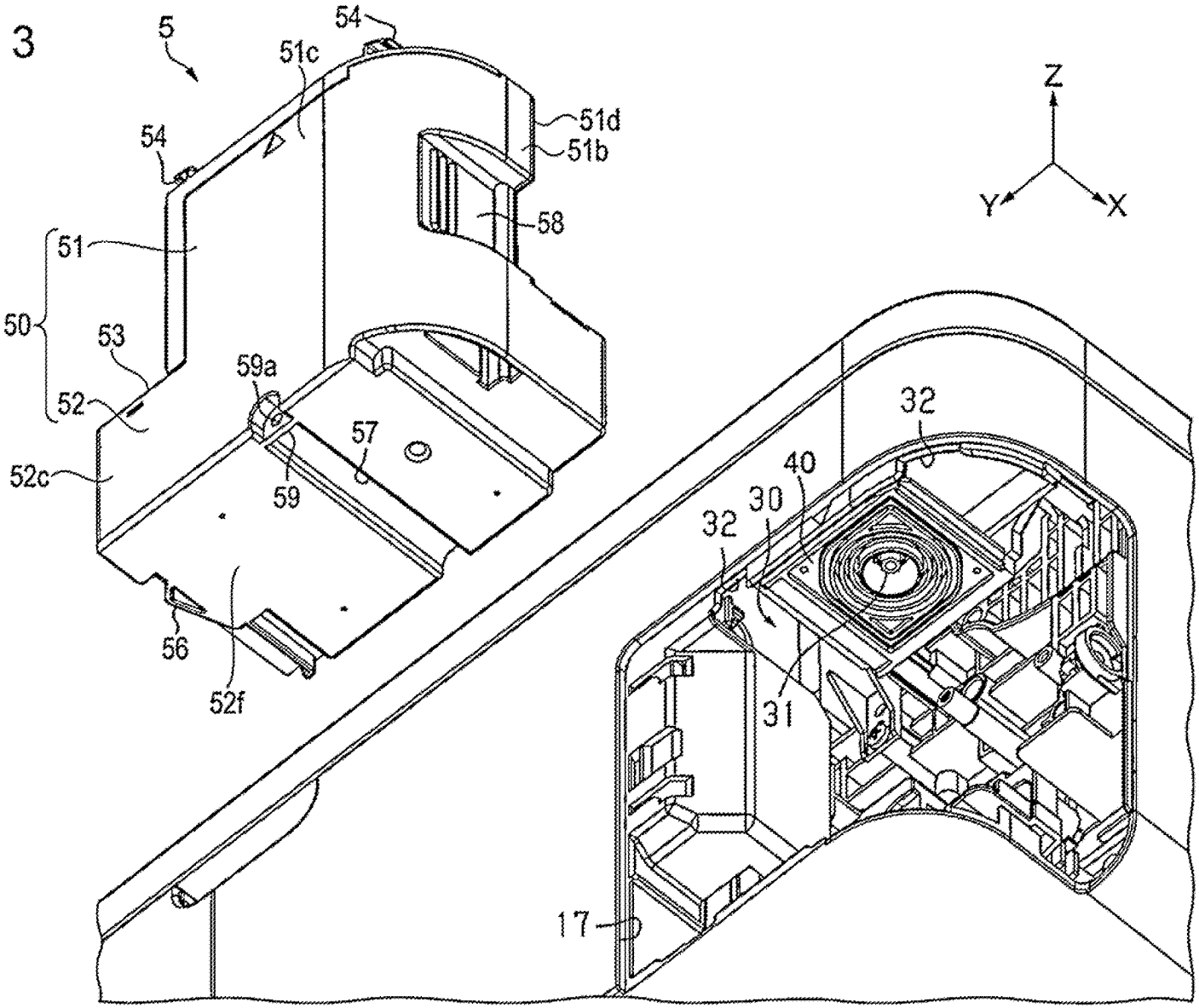
FIG. 3 is a partial perspective view when the state in FIG. 2 is viewed from a down-direction side.

As illustrated in FIGS. 2 and 3, an attachment section 30 to which the waste liquid container 5 is detachably attached is provided inside the opening 17 in the housing 12. The attachment section 30 is able to be exposed to the outside of the housing 12 via the opening 17 and is not visible from the outside when the cover 18 is attached to the opening 17.

As illustrated in FIG. 2, an apparatus-side coupling terminal 33 that is configured to include an elastically deformable terminal fitting or the like is provided in a lower portion inside the attachment section 30 at a position on the front-direction side and the left-direction side. The apparatus-side coupling terminal 33 is electrically coupled, via a flexible flat cable or the like, to a control section (not illustrated) which is provided in the housing 12.

An apparatus-side engagement section 34 formed from a metal plate piece in which a portion on the left-direction side serving as a base end extends in the right-left direction and in which an end on the right-direction side serving as a tip end is mountain-folded in the rear direction is provided in the lower portion inside the attachment section 30 at a position at which the apparatus-side engagement section 34 is adjacent to the down-direction side of the apparatus-side coupling terminal 33. The apparatus-side engagement section 34 is configured such that a portion on the right-direction side which serves as a free end is elastically deformable in the front-rear direction. An apparatus-side mounting section 35 which is cylindrical and has a screw hole 35*a* in a tip end is provided in the lower portion inside the attachment section 30 so as to extend in the right-left direction at a position which is substantially the center of the attachment section 30 on the rear-direction side of the apparatus-side engagement section 34.

As illustrated in FIG. 3, a discharge section 31 that is cylindrical and is capable of discharging the waste liquid downward is provided inside the attachment section 30 on the up-direction side. An apparatus-side alignment section 32 that is able to be used for alignment when the waste liquid container 5 is attached to the attachment section 30 via the opening 17 from the outside of the housing 12 is formed inside the attachment section 30 on the up-direction side. When the attachment section 30 is viewed in the right-left direction which is the direction in which the waste liquid container 5 is attached to the attachment section 30, apparatus-side alignment sections 32 are formed by cut-out to form recessed shapes in which the down-direction side is open at positions interposing the discharge section 31 from both sides in the front-rear direction.

As illustrated in FIGS. 2 and 3, the waste liquid container 5 is substantially rectangular in plan view from the top and includes a storage section 50 (refer to FIG. 5) capable of storing the waste liquid. The storage section 50 includes a first storage section 51 that is positioned on the up-direction side in the up-down direction and a second storage section 52 which is positioned on the down-direction side of the first storage section 51, and the inside of the storage second storage section 52 communicates with the first storage section 51.

In the storage section 50, the second storage section 52 includes an L-shaped level difference section 53 that protrudes in the front direction and the left direction when viewed in plan view from the top compared with the first storage section 51. Due to the presence of the level difference section 53, the second storage section 52 is formed to be larger than the first storage section 51 when viewed in plan view from the top.

An inlet 611 that is open upward is formed in the first storage section 51 of the storage section 50. In the storage section 50, the inlet 611 communicates with an inlet section 75, which will be described later, provided on the down-direction side of the inlet 611. In a state in which the waste liquid container 5 is attached to the attachment section 30, the position of the inlet 611 overlaps, in the up-down direction, that of the discharge section 31, which is positioned inside the attachment section 30 on the up-direction side, and the inlet 611 introduces the waste liquid discharged from the discharge section 31 to the inlet section 75. Note that, in the waste liquid container 5, since the inlet 611 is open upward, it is possible to reduce the resistance when the waste liquid is introduced to the storage section 50, thus making it possible to smoothly discharge the waste liquid into the storage section 50.

In the first storage section 51 of the storage section 50, a pair of container-side alignment sections 54 aligned with and inserted into a pair of apparatus-side alignment sections 32 provided inside the attachment section 30 on the up-direction side when the waste liquid container 5 is attached to the attachment section 30 is provided so as to extend in the right-left direction. When the waste liquid container 5 is attached to the attachment section 30, the right-left direction is the attachment direction, and the pair of container-side alignment sections 54 is formed at a position interposing the inlet 611 from both sides in the front-rear direction which intersects the right-left direction.

A container-side coupling terminal (not illustrated) in contact with and electrically coupled to the apparatus-side coupling terminal 33 in the attachment section 30 when the waste liquid container 5 is attached to the attachment section 30 is provided on a front surface 52*a* of the second storage section 52. A container-side engagement section 56 that engages the apparatus-side engagement section 34 when the waste liquid container 5 is attached to the attachment section 30 is provided on the front surface 52*a* of the second storage section 52 at a position adjacent to the down-direction side of the container-side coupling terminal.

A groove section 57 which has a semicircular sectional shape and into which the apparatus-side mounting section 35 is able to be inserted when the waste liquid container 5 is attached to the attachment section 30 is formed so as to extend in the right-left direction on a lower surface 52*f* of the second storage section 52. A recessed section 58 that extends across a right surface 51*c* and a left surface 51*d* of the first storage section 51 is formed on a rear surface 51*b* of the first storage section 51. Therefore, as illustrated in FIG. 2, when the waste liquid container 5 is attached to the attachment section 30, a user is able to easily grip the waste liquid container 5 by placing fingertips on the recessed section 58 and the front surface 51*a* of the first storage section 51.

As illustrated in FIG. 3, a container-side mounting section 59 that has a wall shape and includes a through hole 59*a* is formed in an end of the groove section 57 on the right-direction side. The waste liquid container 5 is fixed to the attachment section 30 by screwing, into the screw hole 35*a*, a screw member (not illustrated) inserted into the through hole 59*a* in a state in which the apparatus-side mounting section 35 is inserted into the groove section 57.

Figure 4:
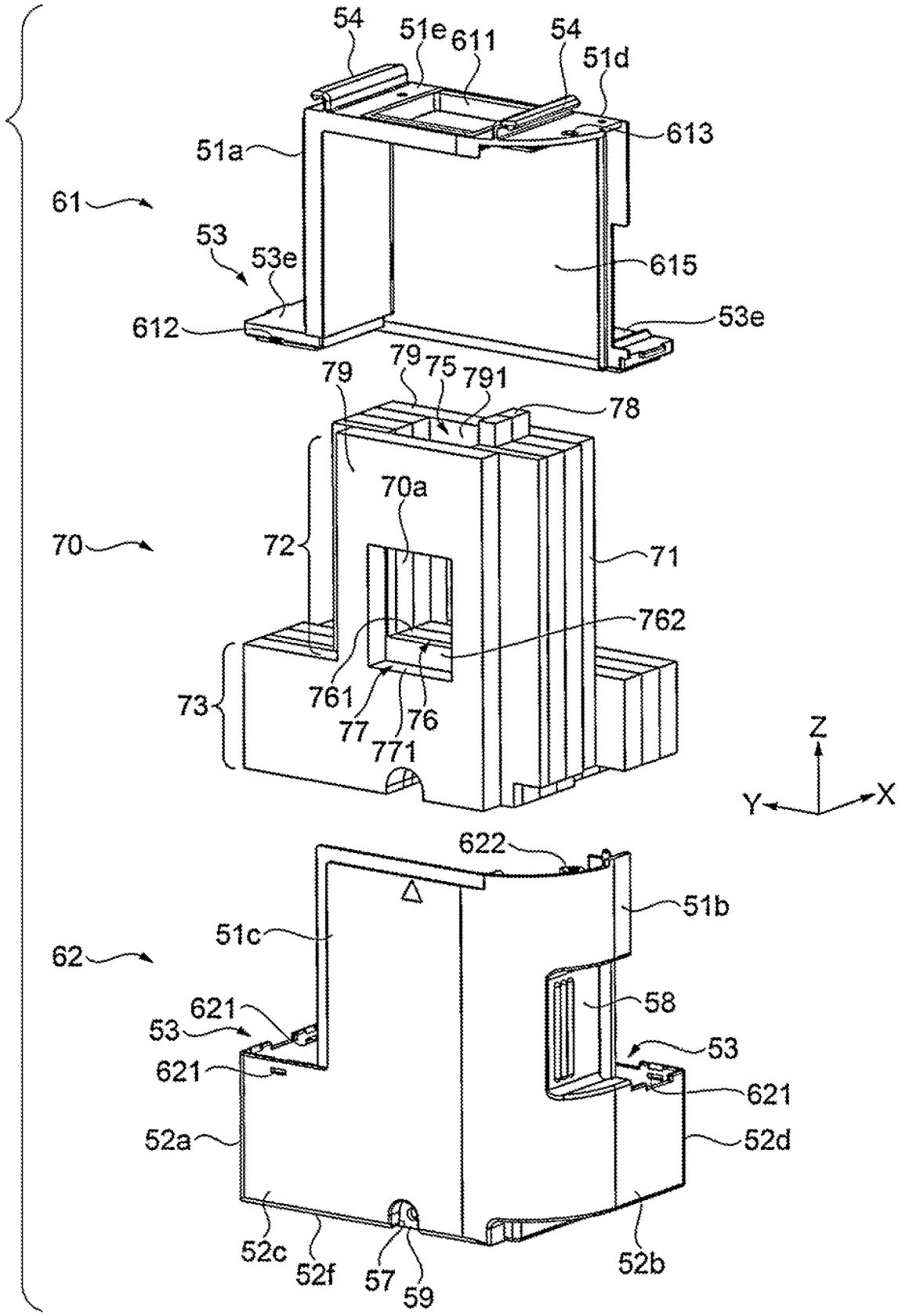
FIG. 4 is an exploded view illustrating a configuration of the waste liquid container.

As illustrated in FIG. 4, the waste liquid container 5 includes, as components, an upper case 61, a lower case 62, and an absorbing member 70 that absorbs the waste liquid. In other words, the storage section 50 includes the upper case 61, the lower case 62, and the absorbing member 70. The absorbing member 70 is disposed in an interior space demarcated by the upper case 61 and the lower case 62.

As illustrated in FIG. 4, the lower case 62 is constituted by the front surface 52*a*, a rear surface 52*b*, a right surface 52*c*, a left surface 52*d*, and the lower surface 52*f* of the second storage section 52. The lower case 62 is also constituted by the rear surface 51*b*, the right surface 51*c*, and the like of the first storage section 51. Note that the level difference section 53, the container-side coupling terminal, the container-side engagement section 56, the groove section 57, the recessed section 58, the container-side mounting section 59, and the like described above are formed in the lower case 62.

The upper case 61 is constituted by an upper surface 53*e* of the level difference section 53. Additionally, the upper case 61 is constituted by the front surface 51*a*, the left surface 51*d*, an upper surface 51*e*, and the like of the first storage section 51. Note that the container-side alignment sections 54, the inlet 611, and the like described above are formed in the upper case 61.

Note that, after the absorbing member 70 is disposed inside the lower case 62, the upper case 61 is placed from above the absorbing member 70, and a plurality of engagement protrusions 612 formed in an end of the upper surface 53*e* engage respective engagement receivers 621 formed in the lower case 62. Then, a screw member SC (refer to FIG. 2) is inserted into a through hole 613 formed in an end of the upper surface 51*e* of the upper case 61 on the rear direction side and is screwed into a screw hole 622 of the lower case 62 that corresponds to the through hole 613, thus forming the storage section 50.

As illustrated in FIG. 4, the absorbing member 70 is a member formed of urethane or the like that absorbs the waste liquid through permeation to thereby store the waste liquid. The absorbing member 70 is constituted by layering a plurality of base members 71 that have a given thickness and that serve as a flat plate, made of urethane. Specifically, the absorbing member 70 is formed into a three-dimensional structure so as to have an appropriate shape and capacity, for example, by forming shapes of the respective layers to differ with respect to the shape of the storage section 50. Note that the absorbing member 70 is configured in a layered manner but may be configured in an integrated manner.

Note that, in the absorbing member 70, a portion corresponding to the first storage section 51 of the storage section 50 serves as a first absorbing section 72, and a portion corresponding to the second storage section 52 serves as a second absorbing section 73 that is continuous to the down-direction side of the first absorbing section 72. The second absorbing section 73 is also constituted by the level difference section 53 of the second storage section 52. Although the details will be described later, the inlet section 75, an accumulation region 76, a groove section 77, a liquid guiding section 78, and the like are constituted by the absorbing member 70, the upper case 61, and the lower case 62. The inlet section 75, the accumulation region 76, the groove section 77, and the liquid guiding section 78 are formed substantially in the first absorbing section 72.

Figure 5:
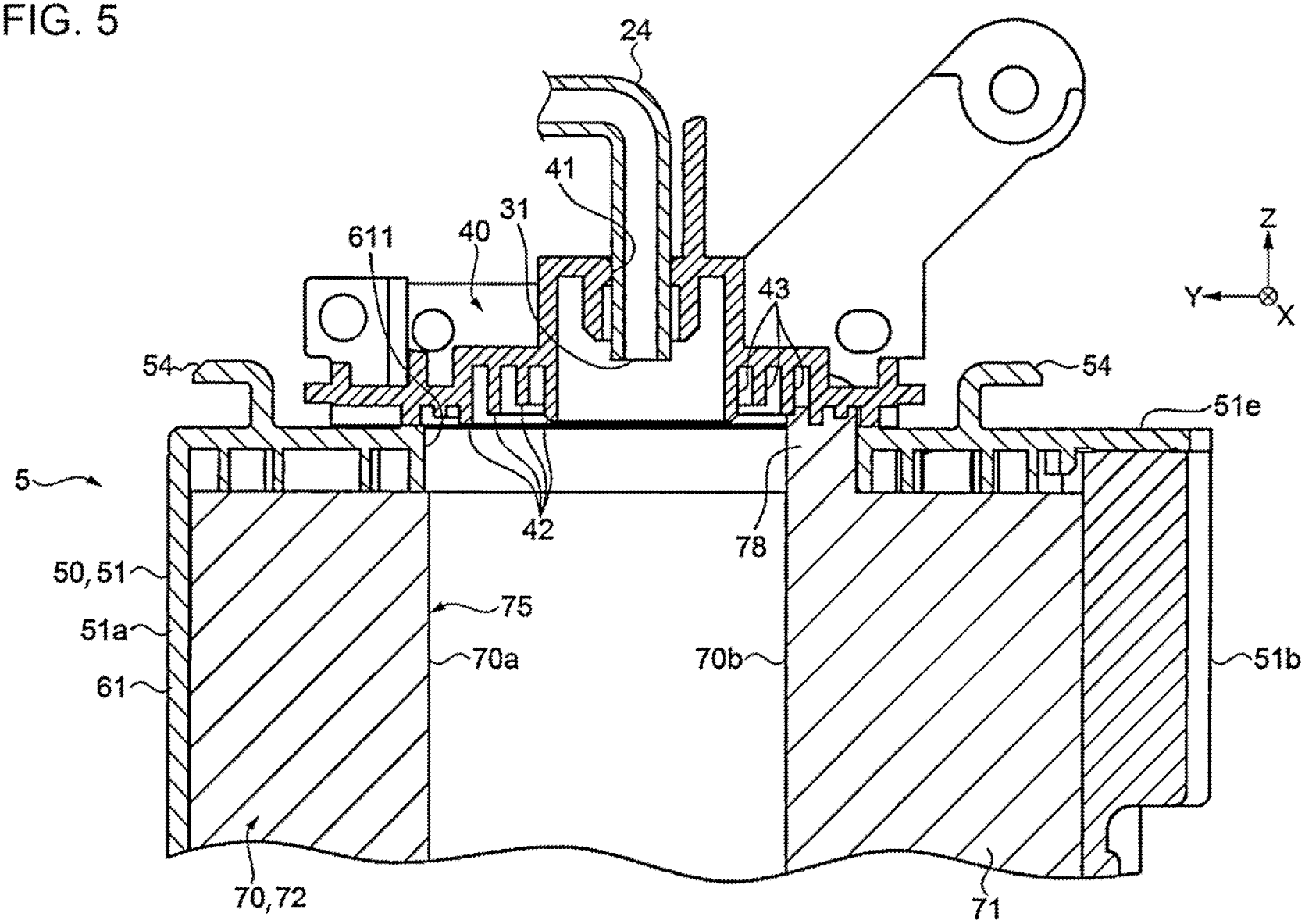
FIG. 5 is a partial sectional view illustrating a positional relationship between a discharge section and the waste liquid container.

As illustrated in FIGS. 3 and 5, a support section 40 that has a rectangular shape when viewed from the top is formed on the top of the attachment section 30, and a hole section 41 that passes through the support section 40 in the up-down direction is formed in substantially the center of the support section 40. The waste liquid tube 24 is inserted into the hole section 41 so as to protrude from the up-direction side to the down-direction side. In the present embodiment, the downstream end of the waste liquid tube 24 inserted into the hole section 41 constitutes the discharge section 31 that discharges the waste liquid to the inlet 611 of the waste liquid container 5.

A plurality of (for example, four) protruding sections 42 that have a concentric circular ring shape centered on the hole section 41 are provided on the surface of the support section 40 on the down-direction side so as to protrude in the down direction by different distances leaving a small gap therebetween in a radial direction. A plurality of (for example, three) recessed sections 43 that also have a concentric circular ring shape centered on the hole section 41 are provided between the protruding sections 42 that are adjacent in the radial direction. The recessed sections 43 are a plurality of narrow concentric grooves and exhibit capillary action to keep the waste liquid (liquid) in the periphery of the discharge section 31.

As illustrated in FIGS. 4 and 5, the absorbing member 70 includes the liquid guiding section 78 having an upper surface, a portion of which is formed so as to protrude upward from the inlet 611. When the waste liquid container 5 is attached to the attachment section 30, the liquid guiding section 78 comes into contact with a protruding section 42 and a recessed section 43 around the discharge section 31 and guides the waste liquid into the waste liquid container 5 (storage section 50).

Figure 6:
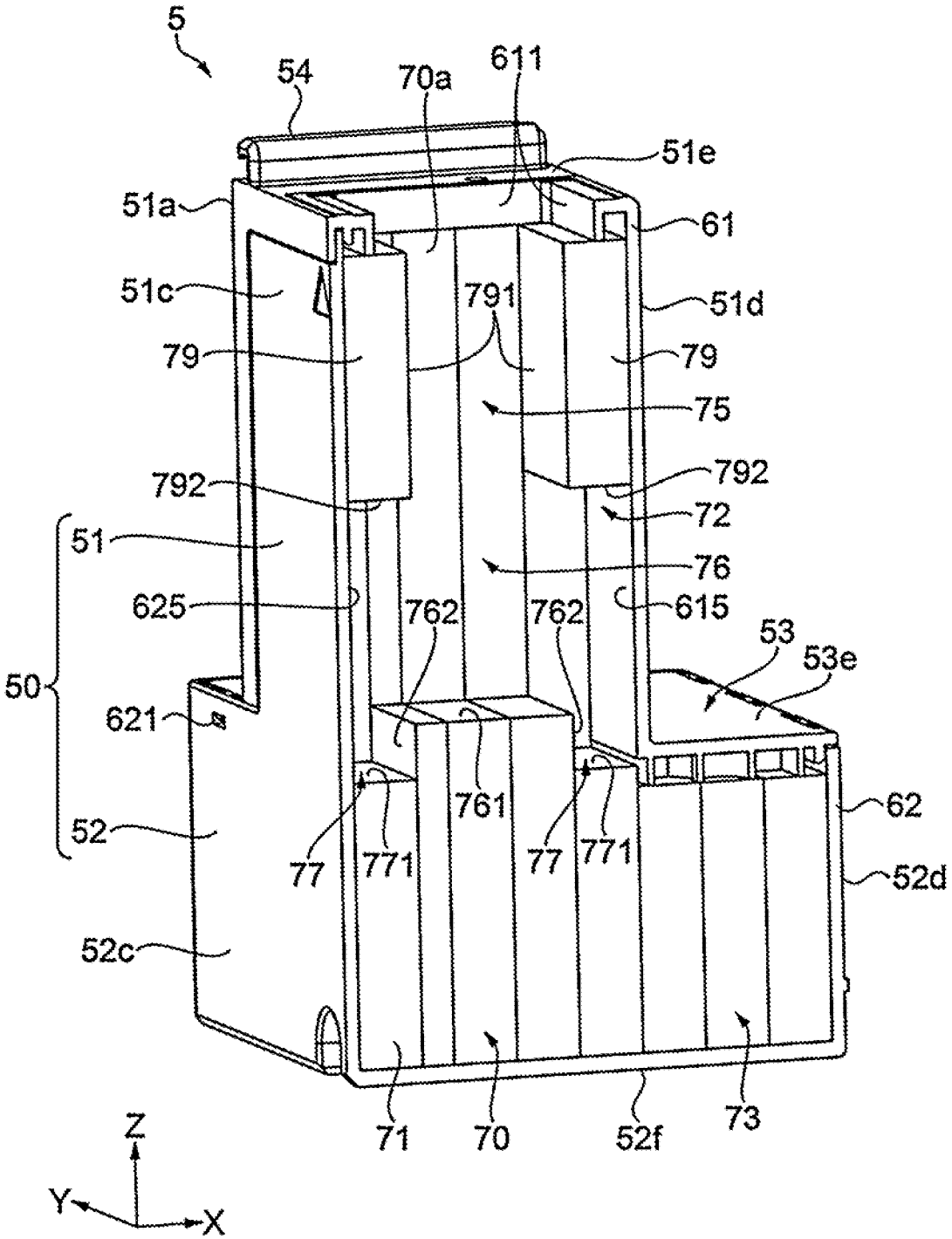
FIG. 6 is a sectional perspective view illustrating the waste liquid container along line VI-VI in FIG. 2.

FIG. 6 is a sectional view of the waste liquid container 5 along line VI-VI illustrated in FIG. 2 viewed from the rear-direction side when the waste liquid container 5 is taken along an X−Z plane orthogonal to the front-rear direction (Y direction). Line VII-VII is also indicated for reference in the absorbing member 70 illustrated in FIG. 7.

Figure 7:
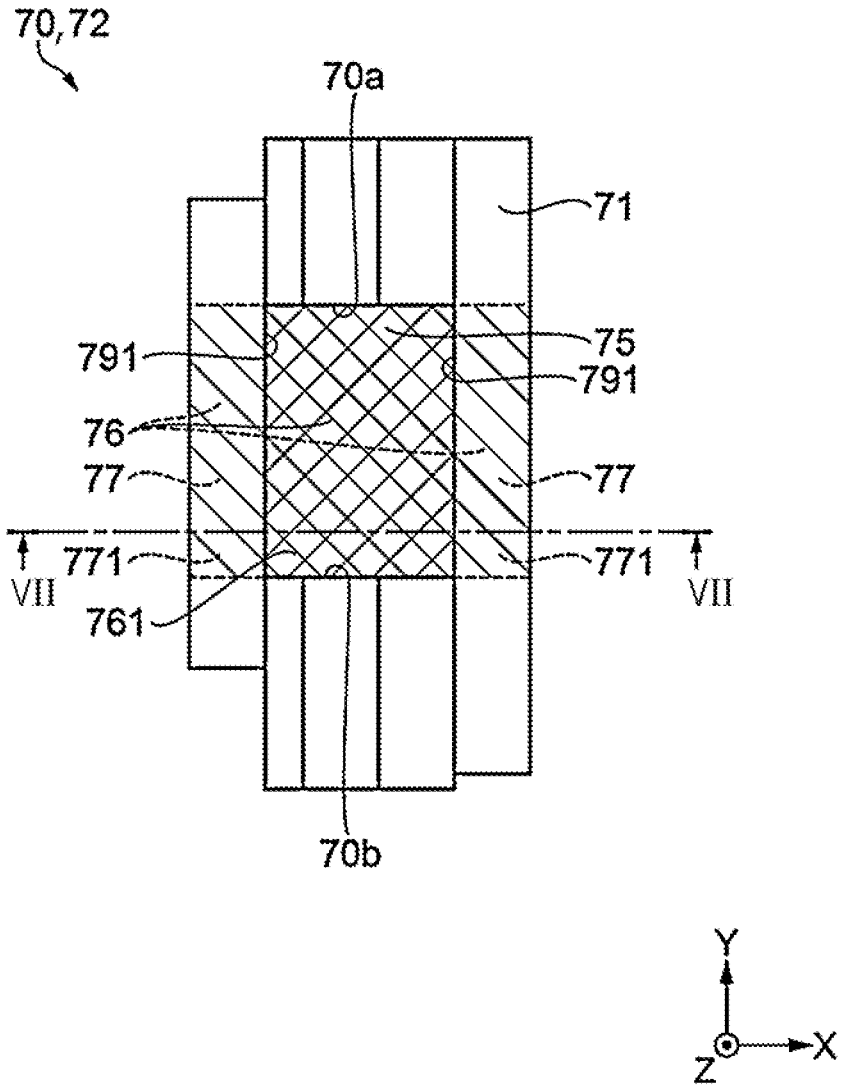
FIG. 7 is a plan view illustrating an inlet section and an accumulation region when a first absorbing section of an absorbing member is viewed from the top.

As illustrated in FIGS. 4, 6, and 7, the waste liquid container 5 is provided with the storage section 50, which includes the upper case 61 and the lower case 62, and the absorbing member 70, and the storage section 50 accommodates the absorbing member 70 therein. The storage section 50 includes the inlet section 75, the accumulation region 76, the groove section 77, and the liquid guiding section 78.

In the absorbing member 70, the inlet section 75 is positioned on the up-direction side and introduces the waste ink (waste liquid) that flows down from the discharge section 31. Note that the inlet section 75 is demarcated by the absorbing member 70 (respective base members 71) in four directions (directions of the X−Y plane) perpendicular to the direction in which the waste liquid flows down (down direction), and the inlet section 75 has a rectangular shape when viewed in plan view from the top.

The accumulation region 76 communicates with the inlet section 75 and is positioned on the down-direction side of the inlet section 75. Similarly to the inlet section 75, the accumulation region 76 also has a rectangular shape when viewed in plan view from the top. In the accumulation region 76, four directions (directions of the X−Y plane) perpendicular to the direction in which the waste liquid flows down (down direction) are formed so as to be surrounded by the absorbing member 70 and inner walls of the storage section 50. Specifically, the accumulation region 76 is surrounded, in the front-rear direction, by the absorbing member 70. The accumulation region 76 is surrounded, in the right-left direction, by the inner walls of the storage section 50.

Here, side surfaces of the base members 71 that surround the accumulation region 76 in the front-rear direction are defined as a front side surface 70*a* and a rear side surface 70*b* (refer to FIG. 7). Thus, the accumulation region 76 is surrounded, in the front-rear direction, by the base members 71, and the front side surface 70*a* faces the rear side surface 70*b*. Note that the accumulation region 76 is surrounded, in the right direction, by an inner wall 625 of the right surface 51*c* constituting the lower case 62. The accumulation region 76 is surrounded, in the left direction, by an inner wall 615 of the left surface 51*d* constituting the upper case 61. Thus, the accumulation region 76 is surrounded, in the right-left direction, by the inner walls of the storage section 50, and the inner wall 615 faces the inner wall 625.

As illustrated in FIG. 6, regarding the absorbing member 70, when a bottom surface of the accumulation region 76 is defined as a bottom surface 761, groove sections 77 each having a bottom surface 771 on the down-direction side of the bottom surface 761 are formed so as to extend in the front-rear direction in ends of the bottom surface 761 in the right-left direction. In the present embodiment, each of the groove sections 77 constitutes the accumulation region 76. Note that, by providing the groove section 77, a side surface 762 extending from the bottom surface 761 of the accumulation region 76 to the bottom surface 771 of the groove section 77 is formed, resulting in an increase in contact area in which the waste liquid is in contact with the absorbing member 70.

When the inlet section 75 and the accumulation region 76 of the absorbing member 70 are viewed in plan view from the top as illustrated in FIG. 7, and when the groove sections 77 are formed in the accumulation region 76, the accumulation region 76 is formed to have an area larger than that of the inlet section 75. Note that, even when no groove section 77 is formed, the accumulation region 76 may be formed to have an area larger than that of the inlet section 75 in plan view.

As illustrated in FIGS. 4 and 6, the right and left base members 71 that form the groove sections 77 in the ends of the accumulation region 76 in the right-left direction each include a suppressing section 79 positioned on the up-direction side of the accumulation region 76. The suppressing sections 79 determine, among the four directions of the inlet section 75 which are perpendicular to the direction in which the waste liquid flows down (down direction), two directions in the right-left direction, and side surfaces 791 of the suppressing sections 79 face each other.

Note that a surface that serves as a lower surface of the suppressing section 79 and forms an upper surface of the accumulation region 76 is defined as a suppressing surface 792. In other words, according to the aforementioned description, the inlet section 75 is surrounded, in the right-left direction, by the suppressing sections 79 in which the side surfaces 791 face each other, and the inlet section 75 is surrounded, in the front-rear direction, by the base members 71 in which the front side surface 70*a* and the rear side surface 70*b* face each other.

A flow of the waste liquid introduced to the storage section 50 will be described.

As described above, the liquid ejecting apparatus 11 of the present embodiment uses sublimation-transfer ink that is likely to be in a bubble form as liquid (ink) for printing. Ink that becomes waste liquid due to maintenance flows down from the discharge section 31 into the storage section 50. Note that, when the waste ink flows down from the discharge section 31, ink in a bubble form is introduced to the inlet section 75 via the inlet 611 as waste ink (waste liquid) together with ink in a liquid form.

The waste liquid in the liquid form introduced to the inlet section 75 comes into contact with the bottom surface 761 of the accumulation region 76 by passing through the inlet section 75 and is absorbed by the absorbing member 70 from the bottom surface 761. When passing through the inlet section 75, the waste liquid in the liquid form attached to the front side surface 70*a*, the rear side surface 70*b*, and the right and left side surfaces 791 in the four directions constituting the inlet section 75 is absorbed by the absorbing member 70 after flowing along the respective surfaces.

On the other hand, the waste liquid in the bubble form introduced to the inlet section 75 comes into contact with the bottom surface 761 of the accumulation region 76 by passing through the inlet section 75 and starts to gradually accumulate in the accumulation region 76 including the bottom surface 761. The waste liquid in the bubble form attached to the respective surfaces constituting the inlet section 75 flows in the down direction along the surfaces, to which the waste liquid is attached, and accumulates in the accumulation region 76. A portion of the waste liquid in the bubble form flowing in the down direction along the respective surfaces is absorbed by the absorbing member 70.

The reason why the waste liquid in the bubble form accumulates in the accumulation region 76 is that the waste liquid in the bubble form, which is difficult for the absorbing member 70 to absorb, takes more time than the waste liquid in the liquid form to be absorbed. Note that the waste liquid in the bubble form accumulates in the accumulation region 76 and comes into contact with the bottom surfaces 761 and 771, the side surface 762, the front side surface 70*a*, and the rear side surface 70*b* and is thereby gradually absorbed by the absorbing member 70.

As described above, when the waste liquid in the liquid form is attached to the inlet section 75 or the accumulation region 76, the waste liquid is absorbed by the absorbing member 70 as is. The waste liquid in the bubble form is not absorbed immediately and thus gradually accumulates in the accumulation region 76, and the accumulated waste liquid in the bubble form is gradually absorbed by the absorbing member 70. Note that the waste liquid absorbed by the absorbing member 70 permeates the entire absorbing member 70 (including the first absorbing section 72 and the second absorbing section 73) accommodated in the storage section 50.

When continuously accumulating in the accumulation region 76, the waste liquid in the bubble form moves upward. In the present embodiment, the suppressing surface 792 of the suppressing section 79 is positioned on the up-direction side of the accumulation region 76. Thus, the waste liquid in the bubble form moving upward is suppressed from moving upward due to the suppressing surface 792 (suppressing section 79) serving as a stopper and is kept in the accumulation region 76. Thereby, the waste liquid in the bubble form is gradually absorbed by the absorbing member 70 even while being suppressed.

As described above, the groove section 77 is formed in the accumulation region 76, and the groove section 77 constitutes the bottom surface 771 and the side surface 762, resulting in an increase in contact area in which the waste liquid accumulated in the accumulation region 76 is in contact with the absorbing member 70. Therefore, the contact area of the waste liquid increases compared with an instance in which no groove section 77 is provided, and the amount of the waste liquid absorbed by the absorbing member 70 thus increases.

Although a description has been given by assuming that the liquid ejecting apparatus 11 of the present embodiment is mounted on the horizontal plane (X–Y plane), the liquid ejecting apparatus 11 may be mounted, for example, such that the rear surface 12*b*, the right surface 12*c*, or the left surface 12*d* is a surface in the down direction when the user carries the liquid ejecting apparatus 11, for example, to another location for installation. When the liquid ejecting apparatus 11 is installed in this manner, the rear surface 51*b*, the right surface 51*c*, or the left surface 51*d* of the waste liquid container 5 is the surface in the down direction in accordance with the liquid ejecting apparatus 11.

In such an instance, the waste liquid container 5 is brought into a state in which the waste liquid in the bubble form accumulated in the accumulation region 76 flows in reverse to the inlet section 75. Even in such a state, however, reverse flow to the inlet section 75 is suppressed while the suppressing surface 792 positioned on the up-direction side of the accumulation region 76 serves as a stopper. Additionally, the waste liquid in the bubble form is gradually absorbed by the suppressing surface 792, a side surface 791, the front side surface 70*a*, and the rear side surface 70*b*. Moreover, the waste liquid in the bubble form and the waste liquid in the liquid form that are attached to the inner walls 615 and 625 constituting the accumulation region 76 are also similarly absorbed by the suppressing surface 792, the side surface 791, the front side surface 70*a*, and the rear side surface 70*b*.

Note that, since the accumulation region 76 configured as described above is formed, a capacity balance between the capacity for accumulating the waste liquid in the bubble form and the capacity of the absorbing member 70 for absorbing the waste liquid in the liquid form is able to be set with the capacity of the storage section 50 as a reference while also considering an experiment, thus making it possible to perform setting with the greatest capacity efficiency.

The present embodiment is able to exert the following effect.

In the waste liquid container 5 of the present embodiment, the waste liquid in the bubble form accumulates in the accumulation region 76, and the inlet section 75 that is positioned on the up-direction side of the accumulation region 76 to communicate with the accumulation region 76 is formed to have an area smaller than that of the accumulation region 76 when viewed in plan view from the top (the accumulation region 76 is formed to have an area larger than that of the inlet section 75 when viewed in plan view from the top). Such a configuration provides a stopper to stop reverse flow (upward movement) of the waste liquid in the bubble form from the accumulation region 76 to the inlet section 75, and the waste liquid in the bubble form thus remains accumulated in the accumulation region 76, thereby suppressing the waste liquid in the bubble form from moving upward. As a result, it is possible to prevent the waste liquid in the bubble form from moving upward, for example, and leaking from the waste liquid container 5.

In the waste liquid container 5 of the present embodiment, the directions perpendicular to the downward flow direction in the accumulation region 76 are determined by the absorbing member 70 and the inner walls 615 and 625 of the storage section 50. Thus, flexibility in determining the directions perpendicular to the downward flow direction in the accumulation region 76 is enhanced. According to such a configuration, a capacity balance between the capacity for accumulating the waste liquid in the bubble form and the capacity of the absorbing member 70 for absorbing the waste liquid in the liquid form is able to be set with the capacity of the storage section 50 as a reference while also considering an experiment, thus making it possible to perform setting with the greatest capacity efficiency.

In the waste liquid container 5 of the present embodiment, the groove section 77 is formed in the absorbing member 70. Thereby, it is possible to increase the contact area of the waste liquid in the bubble form and the absorbing member 70, thus making it possible to increase the amount of the waste liquid in the bubble form to be accumulated and improve absorbing efficiency of the absorbing member 70 for absorbing the waste liquid in the bubble form.

The liquid ejecting apparatus 11 of the present embodiment includes the waste liquid container 5, the liquid ejecting head 14, the discharge section 31, and the attachment section 30. Since such a configuration makes it possible to prevent the waste liquid in the bubble form from leaking from the waste liquid container 5, it is possible to prevent the waste liquid from adhering to fingertips or the like of the user when the user exchanges the waste liquid container 5. It is also possible to prevent the inside of the liquid ejecting apparatus 11 from being soiled by the waste liquid in the bubble form.

2. Second Embodiment

A waste liquid container 5A of the present embodiment differs from the waste liquid container 5 of the first embodiment in that a rib 80 is disposed in the inner wall 625 constituting the accumulation region 76. The other configurations are similar to those of the first embodiment. The same configuration as that of the first embodiment will be given the same reference numeral, and redundant description will be omitted.

Figure 8:
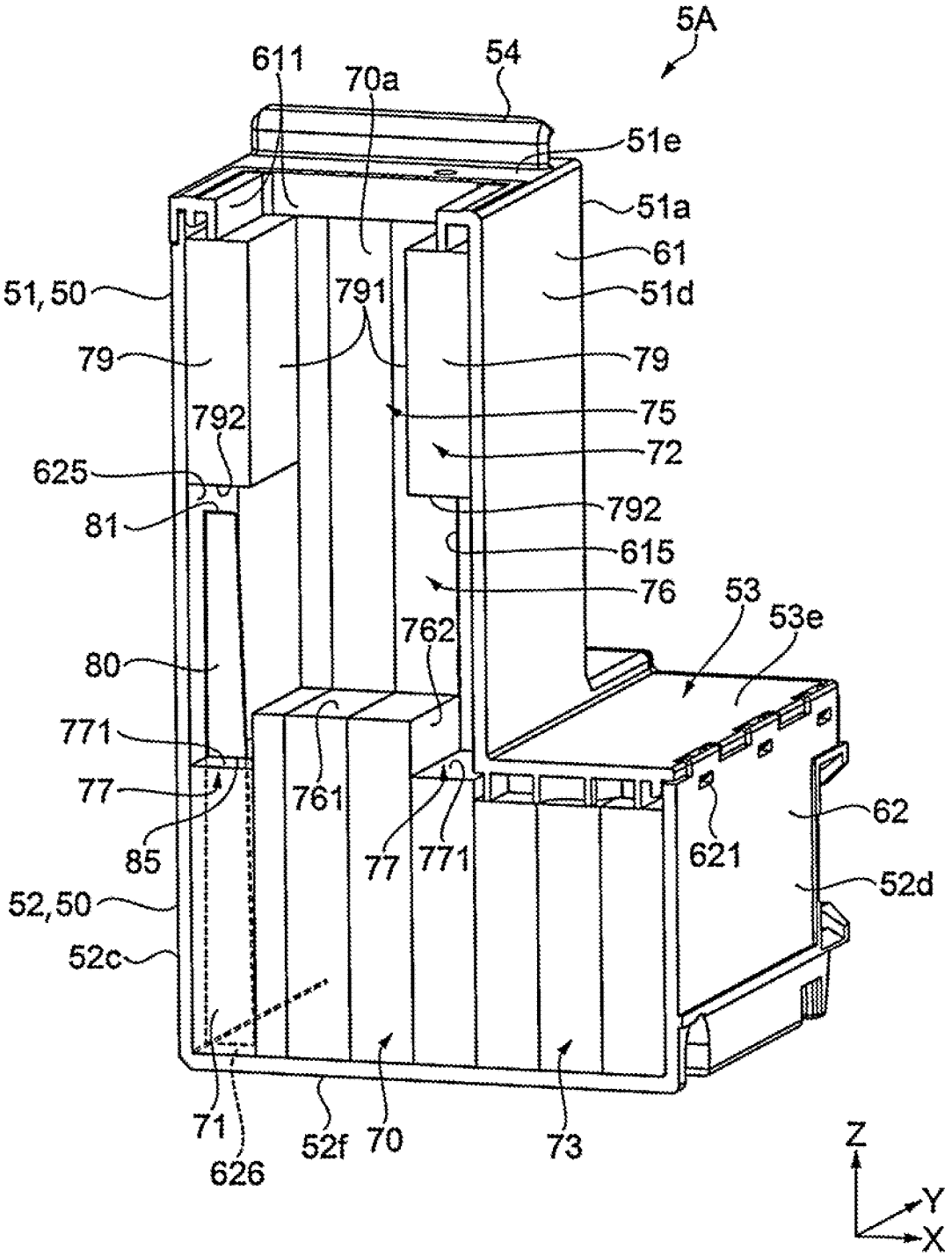
FIG. 8 is a sectional perspective view illustrating a rib of a waste liquid container according to a second embodiment.

As illustrated in FIG. 8, the rib 80 of the present embodiment is formed across the first storage section 51 and the second storage section 52. Specifically, the rib 80 is formed so as to extend in the up-down direction of the inner wall 625 corresponding to inner walls (inner walls of the right surfaces 51*c* and 52*c* of the lower case 62) of the storage section 50. More specifically, the rib 80 is formed so as to protrude from the inner wall 625 to the inside of the accumulation region 76 in the center of the groove section 77 in the front-rear direction.

Moreover, the rib 80 rises from an inner surface 626 inside the lower surface 52*f* of the lower case 62. Thus, a slit 85 that enables the rib 80 to escape is formed in the up-down direction of a base member 71 of the absorbing member 70 constituting the groove section 77. A tip end 81 protruding from the bottom surface 771 of the groove section 77 in the up direction extends up to a position near the suppressing section 79.

The present embodiment is able to exert the following effect in addition to the effect similar to that of the first embodiment.

In the waste liquid container 5A of the present embodiment, since the rib 80 protrudes from the inner wall 625 of the storage section 50 to the inside of the accumulation region 76, when the waste liquid in the bubble form gradually accumulates in the accumulation region 76 via the inlet section 75 while being compressed, the waste liquid in the bubble form is pushed against the rib 80, thus making it possible to collapse bubbles (break and eliminate bubbles). This makes it possible to change the bubble form of the waste liquid to the liquid form and increase the capacity for accumulating the waste liquid in the bubble form.

3. Modified Example 1

In the accumulation region 76 of the first embodiment, the directions perpendicular to the direction in which the waste liquid flows down are determined by the absorbing member 70 and the inner walls 615 and 625 of the storage section 50. However, the perpendicular directions are not limited thereto and may be determined by only the absorbing member 70 or only the inner walls of the storage section 50. Thereby, flexibility in determining the directions perpendicular to the downward flow direction in the accumulation region 76 is enhanced. The same is applicable to the second embodiment.

4. Modified Example 2

In the waste liquid container 5 of the first embodiment, the groove section 77 is formed in the absorbing member 70. However, there is no limitation thereto, and any of a recessed section, a level difference section, and a cut-out section may be formed in the absorbing member 70. Thereby, it is possible to increase the contact area of the waste liquid in the bubble form and the absorbing member 70, thus making it possible to increase the amount of the waste liquid in the bubble form to be accumulated and improve absorbing efficiency of the absorbing member 70 for absorbing the waste liquid in the bubble form. The same is applicable to the second embodiment.

5. Modified Example 3

In the waste liquid container 5A of the second embodiment, the rib 80 is disposed in the inner wall 625 and extends in the up-down direction. However, the rib 80 is not limited thereto and may be disposed in the inner wall 615 or may be disposed not only in the up-down direction but also in the front-rear direction. Moreover, a plurality of ribs may be provided. This makes it possible to collapse bubbles (break and eliminate bubbles). It is therefore possible to change the bubble form of the waste liquid to the liquid form and increase the capacity for accumulating the waste liquid in the bubble form.

6. Modified Example 4

The liquid ejecting apparatus 11 of the first embodiment is constituted by an ink jet printer. The printer adopts, as a printing method, a so-called serial method in which printing is performed while liquid ejecting head 14 is reciprocated in the main-scanning direction intersecting the transport direction of the paper P. However, the liquid ejecting apparatus 11 is not limited thereto and may be a liquid ejecting apparatus adopting a so-called line head method in which the liquid ejecting head 14 is disposed in a fixed manner over the entire width of the transport region of the paper P.

7. Modified Example 5

The absorbing member 70 of the first embodiment is a member absorbing the waste liquid and enabling the waste liquid to permeate into the absorbing member 70 and to be stored and is formed of urethane or the like. However, the absorbing member 70 is not limited thereto and may be a member having an absorbing property including a nonwoven cloth formed of natural fibers or chemical fibers or a porous member such as a sponge. The same is applicable to the second embodiment.

What is claimed is:

1. A waste liquid container detachably attached to an attachment section that is, in a use state, positioned on a down-direction side of a discharge section that discharges waste liquid from a liquid ejecting head, the waste liquid container comprising:

a storage section having an inlet section that is positioned on an up-direction side and that introduces the waste liquid which flows down from the discharge section;

an absorbing member that is accommodated in the storage section and that absorbs the waste liquid introduced to the inlet section, the inlet section being a gap that, in plan view from a top of the waste liquid container, is formed between and surrounded by interior side surfaces of the absorbing member; and an accumulation region that (i) communicates with the inlet section inside the storage section, (ii) is positioned on the down-direction side of the inlet section, (iii) is formed to have an area, when viewed in the plan view from the top, larger than an area of the inlet section, and (iv) is configured to accumulate the waste liquid in a bubble form, wherein a bottom surface of the accumulation region is formed by the absorbing member.

2. The waste liquid container according to claim 1, wherein in the accumulation region, a direction perpendicular to a direction in which the waste liquid flows down is determined by the absorbing member and an inner wall of the storage section, by the absorbing member, or by the inner wall of the storage section.

3. The waste liquid container according to claim 1, wherein in the accumulation region, a rib that protrudes from an inner wall of the storage section to inside the accumulation region is formed in a direction perpendicular to a direction in which the waste liquid flows down.

4. The waste liquid container according to claim 1, wherein any of a recessed section, a groove section, a level difference section, and a cut-out section is formed in the absorbing member.

5. A liquid ejecting apparatus comprising:

the waste liquid container according to claim 1;

a liquid ejecting head that ejects a liquid;

a discharge section that discharges waste liquid from the liquid ejecting head; and an attachment section which is positioned on a down-direction side of the discharge section and to which the waste liquid container is detachably attached.

* * * * *